US012102224B1

(12) United States Patent
Chen

(10) Patent No.: US 12,102,224 B1
(45) Date of Patent: Oct. 1, 2024

(54) WALL HANGER

(71) Applicant: Tong-Fu Chen, Taipei (TW)

(72) Inventor: Tong-Fu Chen, Taipei (TW)

( * ) Notice: Subject to any disclaimer, the term of this patent is extended or adjusted under 35 U.S.C. 154(b) by 24 days.

(21) Appl. No.: 18/324,248

(22) Filed: May 26, 2023

(51) Int. Cl.
*A47B 57/38* (2006.01)
*A47B 96/06* (2006.01)
*A47F 5/08* (2006.01)

(52) U.S. Cl.
CPC ..... *A47B 57/38* (2013.01); *A47B 96/061* (2013.01); *A47B 2220/0036* (2013.01); *A47F 5/08* (2013.01)

(58) Field of Classification Search
CPC ..... A47B 57/38; A47B 96/061; A47B 2220/0036; A47F 5/08
See application file for complete search history.

(56) References Cited

U.S. PATENT DOCUMENTS 6,442,909 B2 * 9/2002 Waalkes ..... A47B 83/001 248/245
7,086,543 B2 8/2006 Remmers
10,299,589 B1 * 5/2019 Lai ..... A47B 57/408
11,627,801 B2 * 4/2023 Chen ..... A47B 57/48 211/187
2018/0132610 A1 * 5/2018 Lu ..... A47B 57/42
2018/0132611 A1 * 5/2018 Lu ..... A47B 61/003

FOREIGN PATENT DOCUMENTS

JP 2015208593 A * 11/2015
TW M568652 U * 10/2018
TW 202245651 A * 12/2022 ..... A47B 57/34

* cited by examiner

*Primary Examiner* — Terrell L McKinnon
*Assistant Examiner* — Ding Y Tan
(74) *Attorney, Agent, or Firm* — Best & Flanagan LLP

(57) ABSTRACT

A wall hanger includes a vertical column including a front wall, a first sidewall having a plurality of first coupling holes, and a second sidewall having a plurality of second sidewalls. A connecting member includes a front board and a sideboard. At least one first coupling member is disposed on the sideboard and is coupled with one of the plurality of first coupling holes. At least one second coupling member extends from a side of the front board. A bracket is disposed in front of the vertical column and includes an arm. The arm includes a rear end having at least one third coupling member selectively engaged with at least one of the plurality of second coupling holes of the second sidewall. The rear end of the arm further includes at least one third coupling hole engaged with the at least one second coupling member.

10 Claims, 8 Drawing Sheets

A - A

WALL HANGER

BACKGROUND OF THE INVENTION

The present invention relates to a wall hanger and, more particularly, to a wall hanger that can be mounted on a wall.

To improve the utility of an indoor space, a hanger can be mounted on a wall to support articles. The size of the hanger can match with the height and width of the wall to improve the applicability.

The hanger generally includes a plurality of vertical columns and a plurality of brackets. The vertical columns are fixed to a wall face. The front side of each vertical column includes a plurality of coupling holes arranged in the vertical direction. Each bracket is substantially parallel to the ground and includes a rear end having a coupling member coupled with one of the coupling holes of an associated vertical column. Thus, the brackets can be fixed by engaging the coupling members with the coupling holes at a proper height. Furthermore, a frame, a mesh or other supporting device can be disposed on top of the brackets.

However, the brackets are only fixed by the rear ends through the engagement between the associated coupling members and the coupling holes of the vertical columns in a single direction, resulting in poor assembly stability. When the brackets are subjected to external forces in different coupling directions, the brackets are apt to loosen or even fall off.

U.S. Pat. No. 7,086,543 discloses a shelving apparatus including a standard having a front side with two rows of slots arranged in the vertical direction for engaging with a bracket. However, the engagement mechanism of the two rows of slots is also a combination in the same coupling direction and, thus, still has the same drawback of assembly stability.

BRIEF SUMMARY OF THE INVENTION

An objective of the present invention is to provide a wall hanger with enhanced assembly stability.

A wall hanger according to the present invention comprises a vertical column, a connecting member, and a bracket. The vertical column is disposed in a vertical direction perpendicular to the ground and including a front wall and first and second sidewalls respectively extending perpendicularly rearward from two sides of the front wall. The first sidewall includes a plurality of first coupling holes arranged in the vertical direction. The second sidewall includes a plurality of second coupling holes arranged in the vertical direction. The connecting member includes a front board parallel to and located in front of the front wall of the vertical column. A sideboard extends perpendicularly rearward from a side of the front board and is aligned with the first sidewall of the vertical column. The sideboard includes at least one first coupling member extending toward the first sidewall and selectively engaged with at least one of the plurality of first coupling holes. At least one second coupling member extends from another side of the front board and extends beyond the front wall of the vertical column and a side of the second sidewall. The bracket is disposed in front of the vertical column and includes an arm. The arm includes a rear end having at least one third coupling member selectively engaged with at least one of the plurality of second coupling holes of the second sidewall of the vertical column. The rear end of the arm further includes at least one third coupling hole engaged with the at least one second coupling member of the connecting member.

In an example, each of the plurality of first coupling holes includes two first tightening walls opposite to each other and having decreasing widths therebetween from top to bottom. Each of the plurality of second coupling holes includes two second tightening walls opposite to each other and having decreasing widths therebetween from top to bottom.

In an example, the at least one first coupling member includes a first lower hooked portion, and a spacing between the first lower hooked portion and the sideboard is slightly greater than a wall thickness of the first sidewall of the vertical column.

In an example, the at least one second coupling member includes a second upper hooked portion.

In an example, the at least one third coupling member includes a third lower hooked portion, and a spacing between the third lower hooked portion and the arm is slightly greater than a wall thickness of the second sidewall.

In an example, the at least one third coupling hole includes two third tightening walls opposite to each other and having increasing widths therebetween from top to bottom.

According to the present invention, the two third coupling members of the bracket and the two first coupling members of the connecting member are respectively coupled with the second sidewall and the first sidewall which are opposite to each other. Furthermore, the bracket is coupled with the connecting member. Therefore, the bracket can cooperate with the connecting member and the vertical column to provide a nearly annular enclosing approach for coupling, providing enhanced assembly stability while avoiding loosening even under external forces in different directions. When an article is placed on the bracket of the wall hanger according to the present invention, the weight of the article can be distributed to the second sidewall of the vertical column and transmitted to the first sidewall via the connecting member. Therefore, the first and second sidewalls of the vertical column 1 evenly support the weight of the article, providing enhanced supporting stability. Furthermore, the weight of the article enables enhanced tightening coupling between the first, second, and third tightening walls and the first, third, and second coupling members, providing enhanced assembly stability.

The present invention will become clearer in light of the following detailed description of illustrative embodiments of this invention described in connection with the drawings.

DETAILED DESCRIPTION OF THE INVENTION

Figure 1:
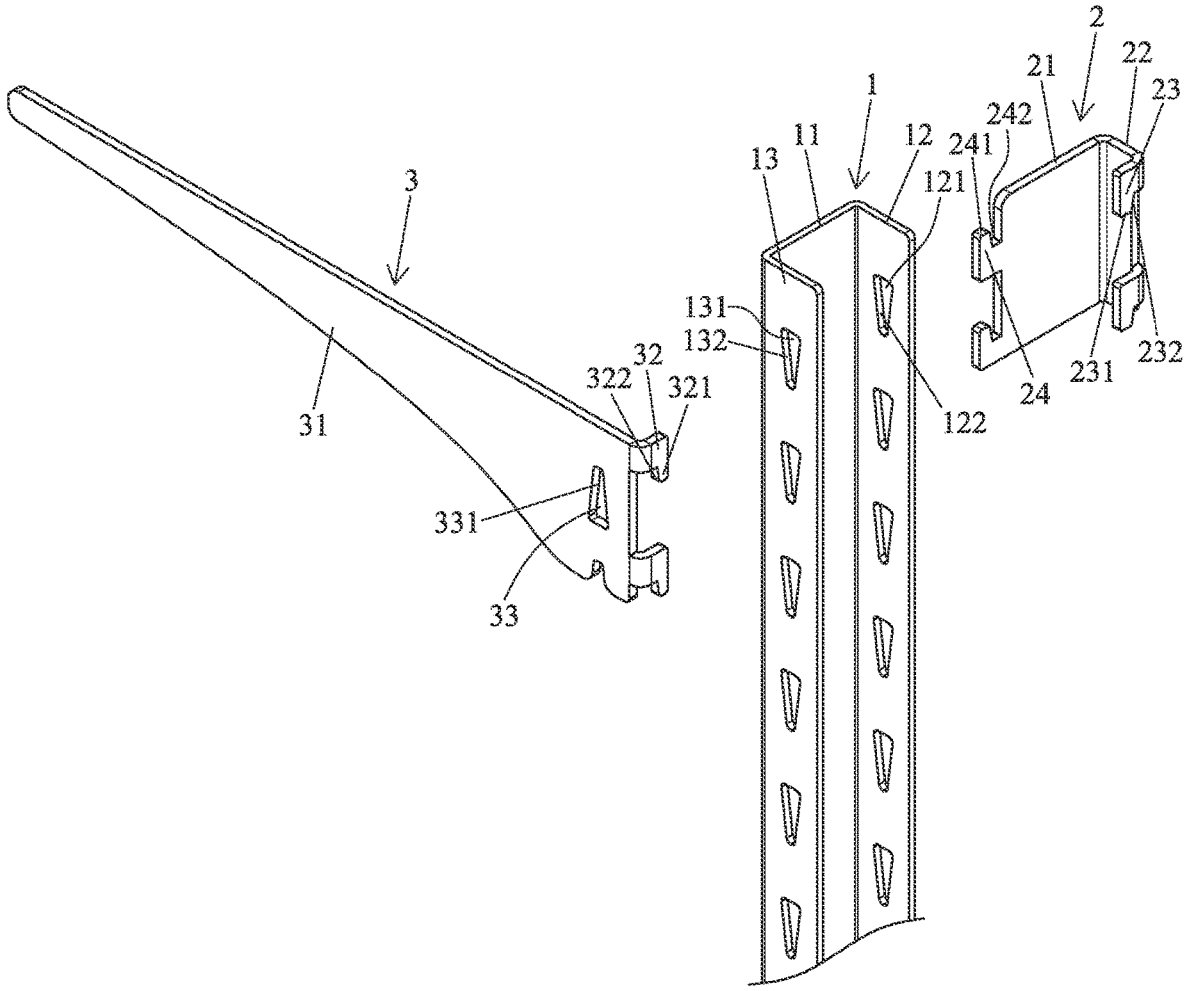
FIG. 1 is an exploded, perspective view of a wall hanger of an embodiment according to the present invention.

Like elements having similar functions in the following embodiments of the present invention are designated by the same reference numbers. With reference to FIGS. 1-6, a wall hanger of an embodiment according to the present invention comprises a vertical column 1, a connecting member 2, and a bracket 3. The vertical column 1 is disposed in a vertical direction perpendicular to the ground and includes a front wall 11 and first and second sidewalls 12 and 13 respectively extending perpendicularly rearward from two sides of the front wall 11. The first sidewall 12 includes a plurality of first coupling holes 121 arranged in the vertical direction. The second sidewall 13 includes a plurality of second coupling holes 131 arranged in the vertical direction. Each of the plurality of first coupling holes 121 includes two first tightening walls 122 opposite to each other and having decreasing widths therebetween from top to bottom. Each of the plurality of second coupling holes 131 includes two second tightening walls 132 opposite to each other and having decreasing widths therebetween from top to bottom.

The connecting member 2 is made of a rigid material and includes a front board 21 parallel to and located in front of the front wall 11 of the vertical column 1. A sideboard 22 extends perpendicularly rearward from a side of the front board 21 and is aligned with the first sidewall 12 of the vertical column 1. The sideboard 22 includes two first coupling member 23 extending toward the first sidewall 12 and selectively engaged with two of the plurality of first coupling holes 121. Each of the two first coupling members 23 includes a first lower hooked portion 231. A spacing between each first lower hooked portion 231 and the sideboard 22 is slightly greater than a wall thickness of the first sidewall 12 of the vertical column 1. Each first lower hooked portion 231 has a first inclined guiding face 232. Two second coupling members 24 extend from another side of the front board 21 and extend beyond the front wall 11 of the vertical column 1 and a side of the second sidewall 13. Each second coupling members 24 includes a second upper hooked portion 241 having a second inclined guiding face 242.

The bracket 3 is disposed in front of the vertical column 1 and includes an arm 31. The arm 31 includes a rear end having two third coupling members 32 selectively engaged with two of the plurality of second coupling holes 131 of the second sidewall 13 of the vertical column 1. Each of the two third coupling members 32 includes a third lower hooked portion 321. A spacing between each third lower hooked portion 321 and the arm 31 is slightly greater than a wall thickness of the second sidewall 13. Each third lower hooked portion 321 has a third inclined guiding face 322. The rear end of the arm 31 further includes two third coupling holes 33 engaged with the two second coupling members 24 of the connecting member 2. Each of the two third coupling holes 33 includes two third tightening walls 331 opposite to each other and having increasing widths therebetween from top to bottom.

Figure 7:
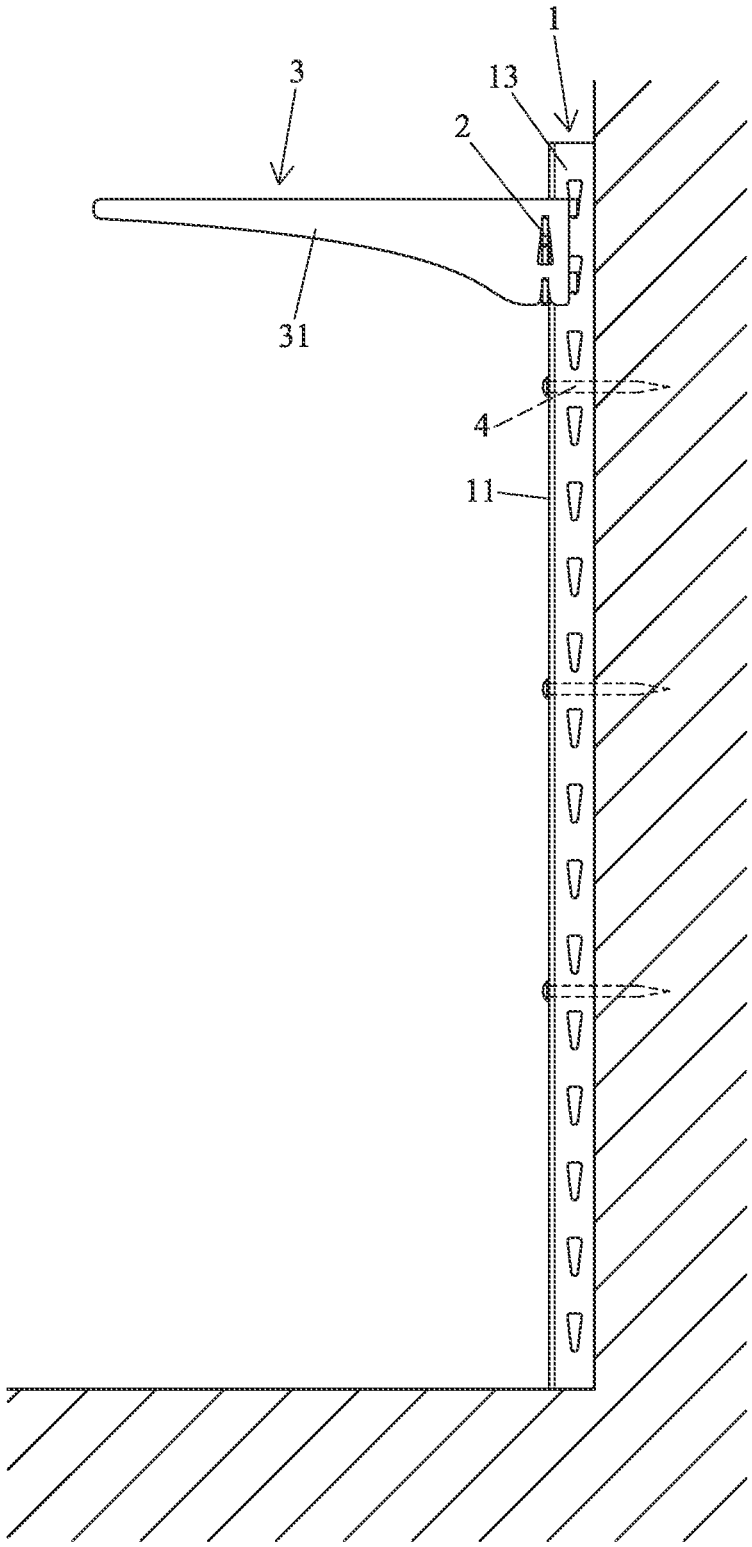
FIG. 7 is a side schematic view illustrating mounting of the wall hanger according to the present invention on a wall.

With reference to FIGS. 1 and 7, the vertical column 1 according to the present invention can be disposed perpendicularly to the ground, and the rear ends of the first and second sidewalls 12 and 13 abut a wall. Fasteners 4 extend through the front wall 11 to securely connect with the wall, such that the vertical column 1 can be fixed to the wall. In other embodiments according to the present invention, the vertical column 1 may be securely connected to the wall by measures other than the above example.

Figure 2:
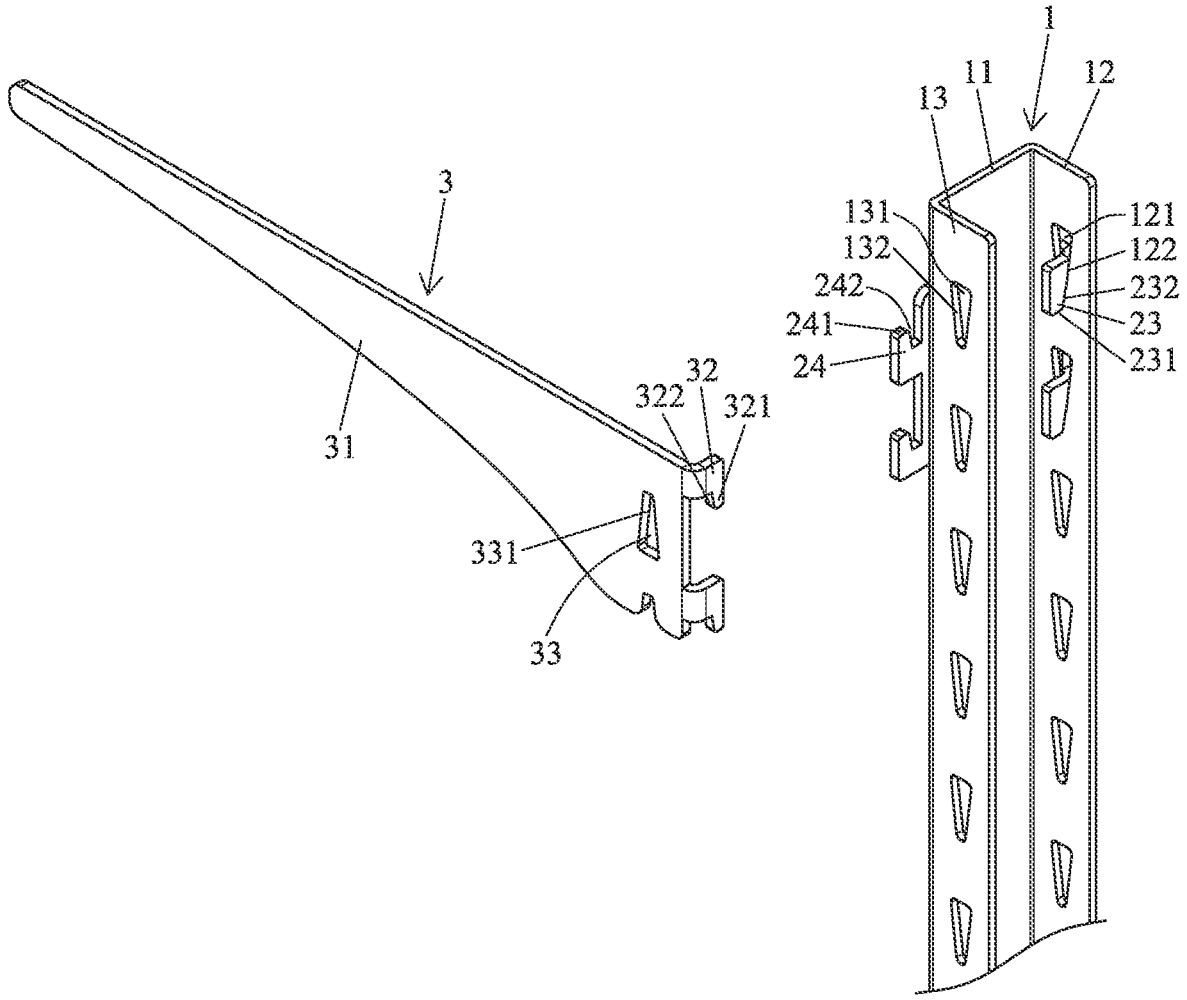
FIG. 2 is an exploded, perspective view of the wall hanger of FIG. 1 with a connecting member coupled to a vertical column of the wall hanger according to the present invention.
Figure 3:
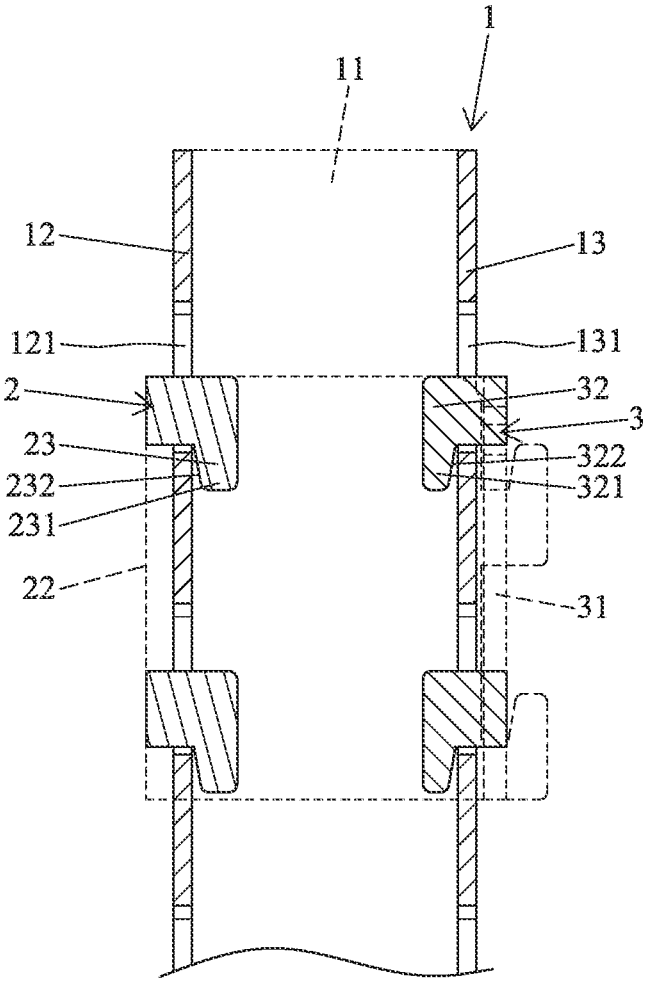
FIG. 3 is a cross sectional view illustrating coupling of the connecting member and the vertical column of the wall hanger according to the present invention.
Figure 4:
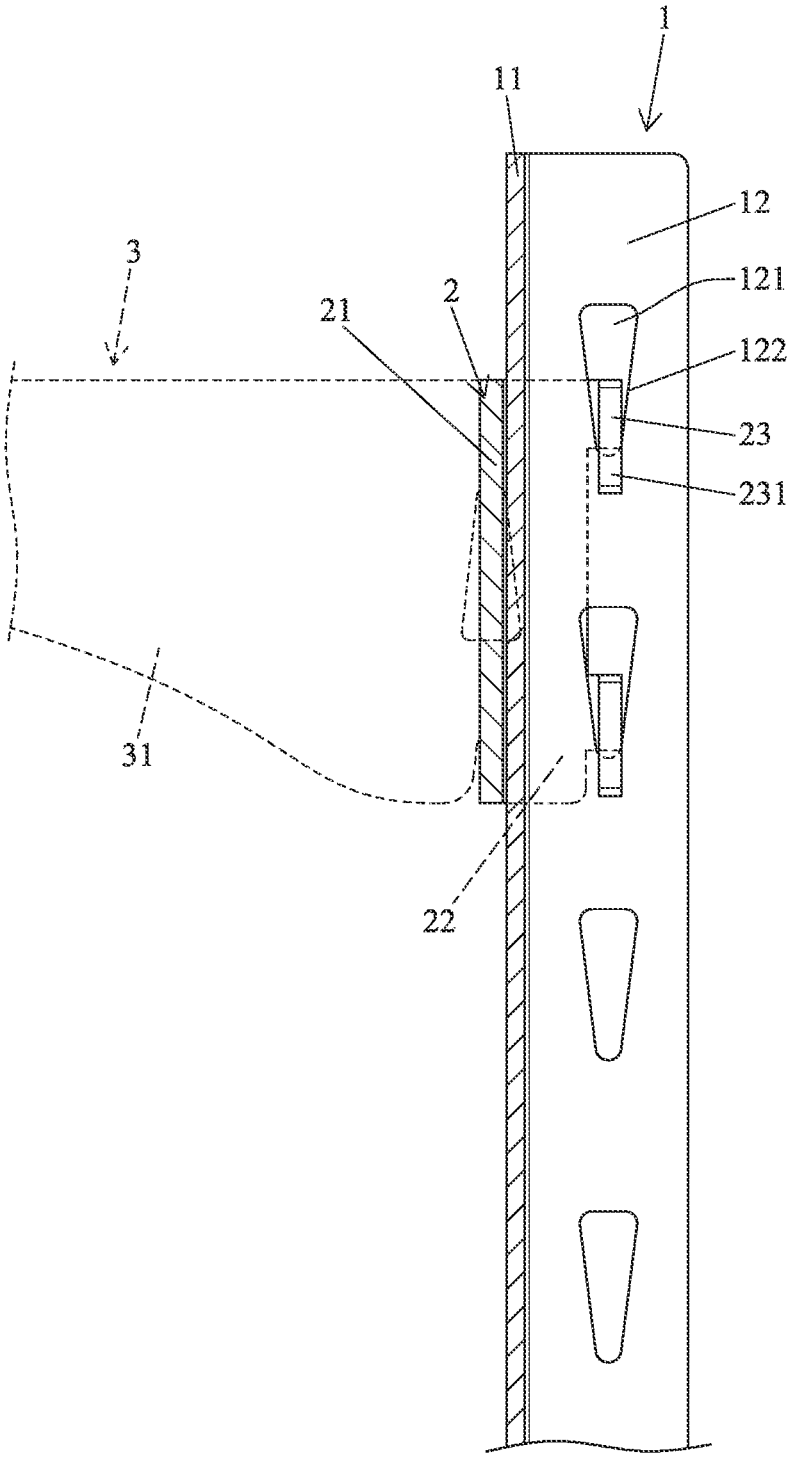
FIG. 4 is another cross sectional view illustrating coupling of the connecting member and the vertical column of the wall hanger according to the present invention.
Figure 5:
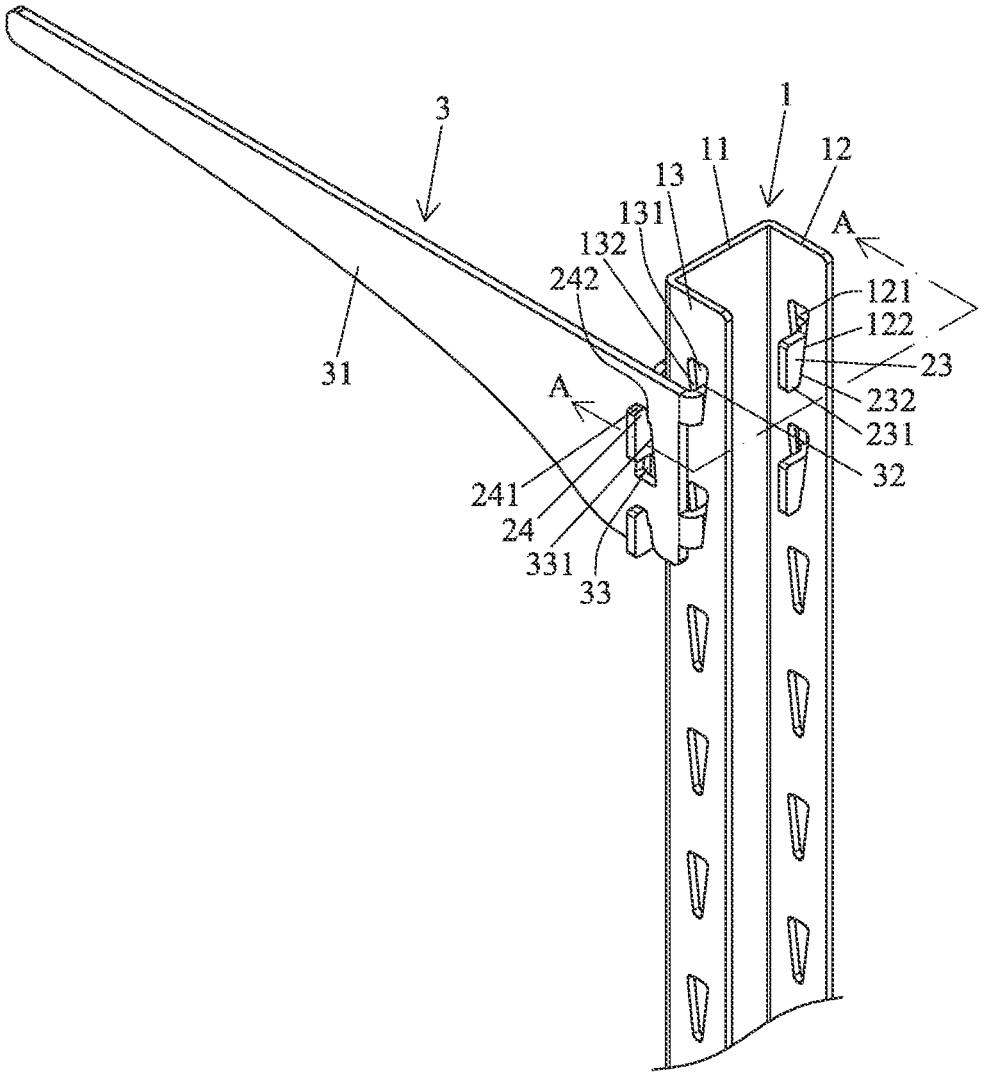
FIG. 5 is a partial, perspective view of the wall hanger according to the present invention after assembly.

In assembly of the present invention, as shown in FIG. 2, each of the two first coupling members 23 of the connecting member 2 is coupled with one of the plurality of first coupling holes 121 of the vertical column 1. When the connecting member 2 slides downward under the action of the gravitational force, each first inclined guiding face 232 guides the sideboard 22 to move toward the first sidewall 12. Furthermore, the first tightening walls 122 can clamp the first lower hooked portions 231, providing a more stable hooking effect.

With references to FIGS. 1-6, each of the two third coupling members 32 of the bracket 3 is coupled with one of the plurality of second coupling holes 131, and each of the two second coupling members 24 of the connecting member 2 is coupled with one of the plurality of third coupling holes 33 of the bracket 3. Furthermore, when the bracket 3 moves downward under the action of the gravitational force, the second and third inclined guiding faces 242 and 322 permit the arm 31 to move toward the second sidewall 13 of the vertical column 1. Furthermore, the second tightening walls 122 can clamp the third lower hooked portions 321, and the third tightening walls 331 can clamp the second upper hooked portions 241, providing a more stable hooking effect.

Figure 8:
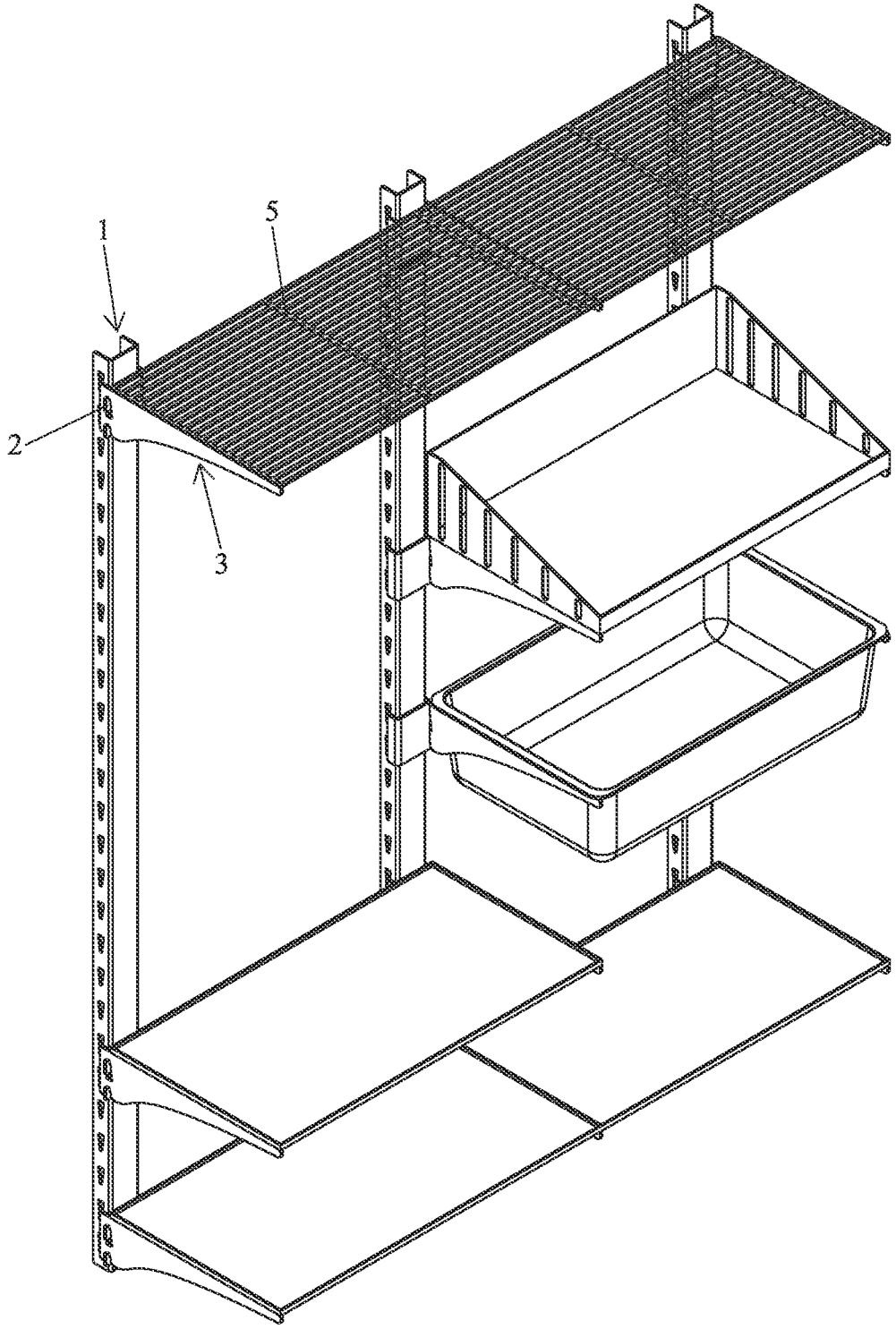
FIG. 8 is a perspective view illustrating an example of application of plural wall hangers according to the present invention.

With reference to FIG. 8, according to the present invention, a plurality of vertical columns 1, a plurality of connecting members 2, and a plurality of brackets 3 may be used according to the area of the wall. Various article supporting devices 5 may be disposed on top of and supported by the brackets 3. Since the brackets 3 are coupled with the first and second coupling holes 121 and 131 of the associated vertical columns 1, the front wall 11 of each vertical column 1 is free of coupling holes. Therefore, in comparison with conventional hangers with coupling holes in the front side, the wall face may have a better overall appearance quality as viewed from the front side.

Figure 6:
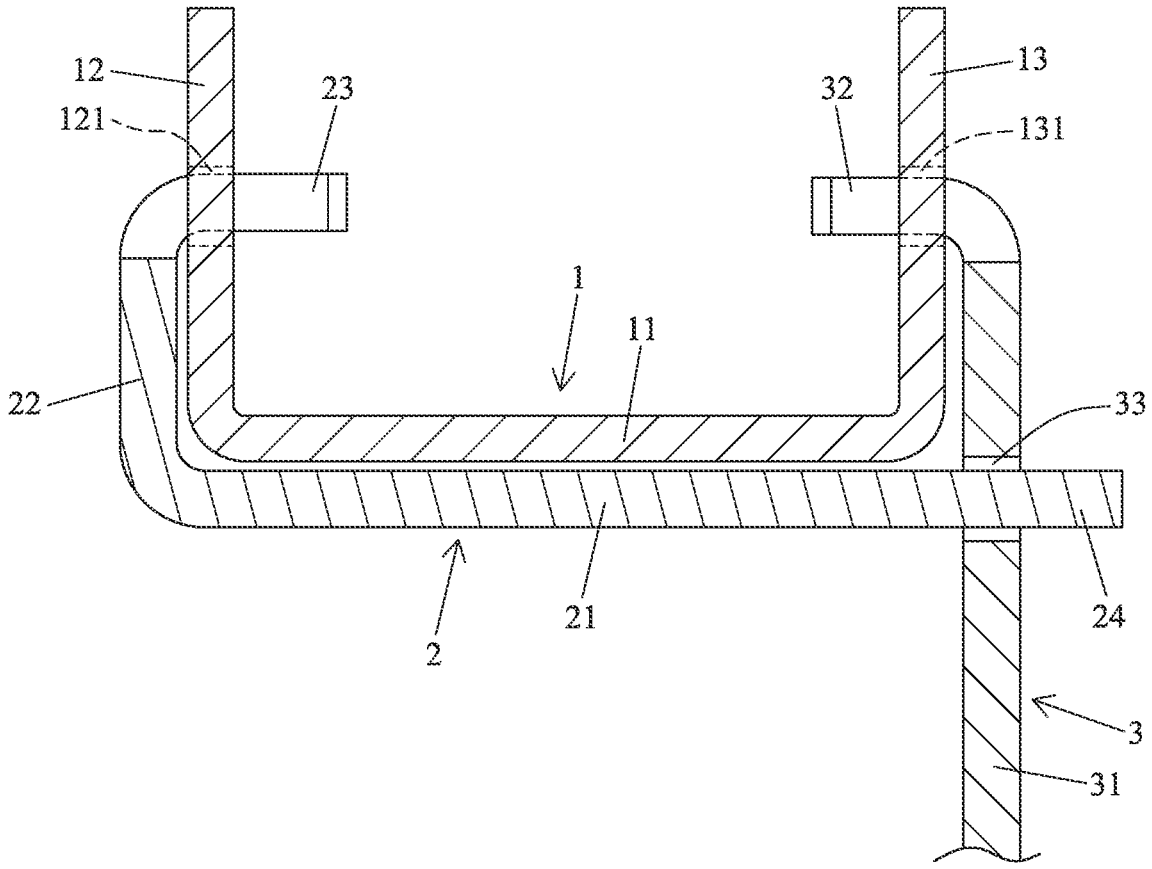
FIG. 6 is a cross sectional view taken along section line A-A of FIG. 5.

As shown in FIG. 6, by the structure of the wall hanger according to the present invention, the two third coupling members 32 of the bracket 3 and the two first coupling members 23 of the connecting member 2 are respectively coupled with the second sidewall 13 and the first sidewall 12 which are opposite to each other. Furthermore, the bracket 3 is coupled with the connecting member 2. Therefore, the bracket 3 can cooperate with the connecting member 2 and the vertical column 1 to provide a nearly annular enclosing approach for coupling, providing enhanced assembly stability while avoiding loosening even under external forces in different directions.

When an article is placed on the bracket 3 of the wall hanger according to the present invention, the weight of the article can be distributed to the second sidewall 13 of the vertical column 1 and transmitted to the first sidewall 12 via the connecting member 2. Therefore, the first and second sidewalls 12 and 13 of the vertical column 1 evenly support the weight of the article, providing enhanced supporting stability. Furthermore, the weight of the article enables enhanced tightening coupling between the first, second, and third tightening walls 122, 132, and 331 and the first, third, and second coupling members 23, 32 and 24, providing enhanced assembly stability.

In view of the foregoing, the wall hanger according to the present invention provides a better combination and better supporting stability.

The foregoing embodiments are examples of the present invention, not limitation to the present invention. All equivalent changes made in accordance with the spirit of the present invention should also fall within the scope of the present invention.

The invention claimed is:

1. A wall hanger comprising:

a vertical column disposed in a vertical direction perpendicular to a ground and including a front wall and first and second sidewalls respectively extending perpendicularly rearward from two sides of the front wall, wherein the first sidewall includes a plurality of first coupling holes arranged in the vertical direction, and wherein the second sidewall includes a plurality of second coupling holes arranged in the vertical direction;

a connecting member including a front board parallel to and located in front of the front wall of the vertical column, wherein a sideboard extends perpendicularly rearward from a side of the front board and is aligned with the first sidewall of the vertical column, wherein the sideboard includes at least one first coupling member extending toward the first sidewall and selectively engaged with at least one of the plurality of first coupling holes, and wherein at least one second coupling member extends from another side of the front board and extends beyond the front wall of the vertical column and a side of the second sidewall; and a bracket disposed in front of the vertical column and including an arm, wherein the arm includes a rear end having at least one third coupling member selectively engaged with at least one of the plurality of second coupling holes of the second sidewall of the vertical column, and wherein the rear end of the arm further includes at least one third coupling hole engaged with the at least one second coupling member of the connecting member.

2. The wall hanger as claimed in claim 1, wherein the at least one first coupling member includes two first coupling members, wherein the at least one second coupling member includes two second coupling members, wherein the at least one third coupling member includes two third coupling members, and wherein the at least one third coupling hole includes two third coupling holes.

3. The wall hanger as claimed in claim 1, wherein each of the plurality of first coupling holes includes two first tightening walls opposite to each other and having decreasing widths therebetween from top to bottom, and wherein each of the plurality of second coupling holes includes two second tightening walls opposite to each other and having decreasing widths therebetween from top to bottom.

4. The wall hanger as claimed in claim 1, wherein the at least one first coupling member includes a first lower hooked portion, and wherein a spacing between the first lower hooked portion and the sideboard is slightly greater than a wall thickness of the first sidewall of the vertical column.

5. The wall hanger as claimed in claim 4, wherein the first lower hooked portion has a first inclined guiding face.

6. The wall hanger as claimed in claim 1, wherein the at least one second coupling member includes a second upper hooked portion.

7. The wall hanger as claimed in claim 6, wherein the second upper hooked portion has a second inclined guiding face.

8. The wall hanger as claimed in claim 1, wherein the at least one third coupling member includes a third lower hooked portion, and wherein a spacing between the third lower hooked portion and the arm is slightly greater than a wall thickness of the second sidewall.

9. The wall hanger as claimed in claim 8, wherein the third lower hooked portion has a third inclined guiding face.

10. The wall hanger as claimed in claim 1, wherein the at least one third coupling hole includes two third tightening walls opposite to each other and having increasing widths therebetween from top to bottom.

* * * * *